US006772706B2

(12) United States Patent
Cassell

(10) Patent No.: US 6,772,706 B2
(45) Date of Patent: Aug. 10, 2004

(54) PERSONAL WATERCRAFT WITH REAR HANDLE

(75) Inventor: Shannon Cassell, Palm Beach, FL (US)

(73) Assignee: Bombardier Recreational Products Inc., Saint-Bruno (CA)

( * ) Notice: Subject to any disclaimer, the term of this patent is extended or adjusted under 35 U.S.C. 154(b) by 0 days.

(21) Appl. No.: 10/194,962

(22) Filed: Jul. 15, 2002

(65) Prior Publication Data

US 2004/0007167 A1 Jan. 15, 2004

(51) Int. Cl.[7] ..... B63B 17/00
(52) U.S. Cl. ..... 114/362; 114/55.57; 114/63
(58) Field of Search ..... 114/362, 363, 114/55.57

(56) References Cited

U.S. PATENT DOCUMENTS 5,490,474 A * 2/1996 Ikeda ..... 114/343
5,537,948 A 7/1996 Kobayashi
5,964,172 A 10/1999 Ikeda
6,435,119 B1 * 8/2002 Pelletier et al. ..... 114/55.51

OTHER PUBLICATIONS

2000 Sea–Doo LRV 5688 Parts Catalog (May, 1999).
2000 Sea–Doo GS 5644/5827 Parts Catalog (Dec., 1999).
1969 Sea–Doo LRV (1969).
1991 Sea–Doo 5811 Parts Catalog (1991).

* cited by examiner

*Primary Examiner*—Sherman Basinger
(74) *Attorney, Agent, or Firm*—BRP Legal Services

(57) ABSTRACT

A personal watercraft has a handle rigidly attached to a rear portion of a deck pedestal. The handle has an elongate hand hold being disposed at a vertical position below a seat top surface and above a deck re-boarding platform. The hand hold spans between top and bottom attachment positions and is disposed at an angle of at least 30 degrees with respect to a horizontal surface. A handle for a watercraft is also described.

15 Claims, 5 Drawing Sheets

PERSONAL WATERCRAFT WITH REAR HANDLE

BACKGROUND OF THE INVENTION

1. Field of the Invention

The field of the invention relates to watercraft that include a rear handle sometimes referred to as a "grab handle."

2. Description of the Related Art

A personal watercraft is defined as a vessel which uses an inboard motor powering a water jet pump as the primary source of motive power. A personal watercraft is designed to be operated by a person sitting in a straddle position. The jet pump works by drawing water into a intake passage ahead of an impeller. The impeller is contained within a pump housing. The impeller pressurizes the water as it enters the pump housing, and forces the water from the stern of the watercraft. The force of the water exiting from the rear of the watercraft propels the personal watercraft.

Handles are provided so that the passenger(s) of the personal watercraft may secure themselves to the vehicle by grasping the handles.

On personal watercraft having a straddle-type seat, such handles generally are disposed at a position near the stem. The handle (or handles) allows (allow) a passenger to hold on to the personal watercraft while the personal watercraft is in motion.

The handle (or handles) is (are) particularly useful if the passenger is facing toward the stem of the personal watercraft, such as when the passenger is spotting a water-skier. Handles used by a passenger are typically generally horizontally-disposed on the personal watercraft. Although a generally horizontally-disposed handle may be grasped easily while the personal watercraft is in motion, a generally horizontally-disposed handle is not disposed in an ergonomic position for a person to use when boarding the personal watercraft from a body of water.

A need, therefore, has developed for a personal watercraft that maximizes the ease in which a person can board the watercraft. Specifically, a need has developed for a handle disposed on a personal watercraft that maximizes the ease with which a person can board the watercraft.

SUMMARY OF THE INVENTION

It is therefore an object of the present invention to provide a simple, cost effective, handle for use with a personal watercraft which maximizes the ease with which a person can board the watercraft.

It is another object of the present invention to provide a handle which may be used by passengers seated on the personal watercraft.

It is yet another object of the present invention to provide a handle which is also usable to passengers seated on the personal watercraft while they are facing either the stern or the bow of the personal watercraft.

In furtherance of the objects, one aspect of the present invention is to provide a personal watercraft having a hull with a bow and a stem. An engine is disposed in the hull. A propulsion unit is driven by the engine. A steering unit is provided to steer the propulsion unit. A deck is supported by the hull at a position above the hull. The deck has a substantially horizontal re-boarding platform at a position proximate to the stem and a pedestal extending upwardly with respect to the re-boarding platform. The personal watercraft has a seat having a top surface and a bottom surface supported by the pedestal. A handle is rigidly attached to a rear portion of the pedestal. The handle has an elongate hand hold being disposed at a vertical position below the seat top surface and above the re-boarding platform. The hand hold spans between top and bottom attachment positions and is disposed at an angle of at least about 30 degrees with respect to the re-boarding platform.

Another aspect of the invention is to provide a grab handle for a watercraft. The grab handle includes a body attachable to a watercraft, the body having a central, generally horizontal portion and right and left side portions extending downwardly from the central portion to right and left bottom edges. The body defines a central, elongate hand hold within the central portion and right and left elongate hand holds extending through the right and left side portions from positions adjacent the central portion to positions adjacent bottom edges of the right and left side portions. The right and left hand holds are both disposed at angles of at least about 30 degrees with respect to the horizontal portion.

It is understood that the invention is not limited solely to the aspect set forth above. To the contrary, other aspects of the invention will be made apparent from the description and claims that follow.

BRIEF DESCRIPTION OF THE DRAWINGS

Reference will be made hereinafter to the accompanying drawings, which illustrate embodiments of the present invention discussed herein below, wherein.

DETAILED DESCRIPTION OF EMBODIMENT (S) OF THE INVENTION

Figure 1:
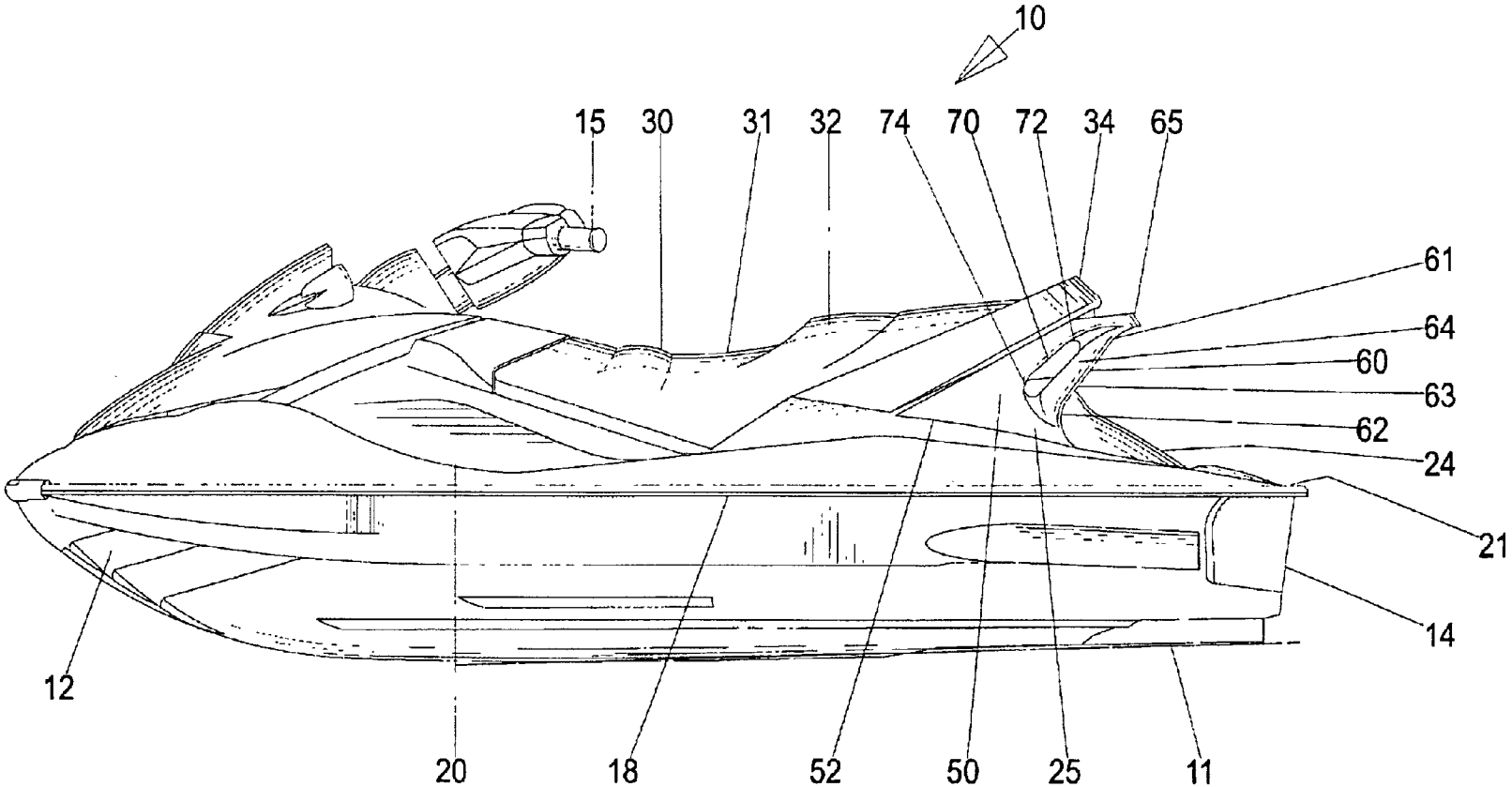
FIG. 1 is a side view of a personal watercraft of the present invention showing a rear handle.

FIG. 1 shows a personal watercraft 10 having a hull 11 having a bow 12 defining a forward most portion of the hull 11, and a stem 14 defining a rearward most portion of the hull 11. The bow 12 and stem 14 are defined according to the normal, forward motion of the watercraft 10 in the water.

Figure 2:
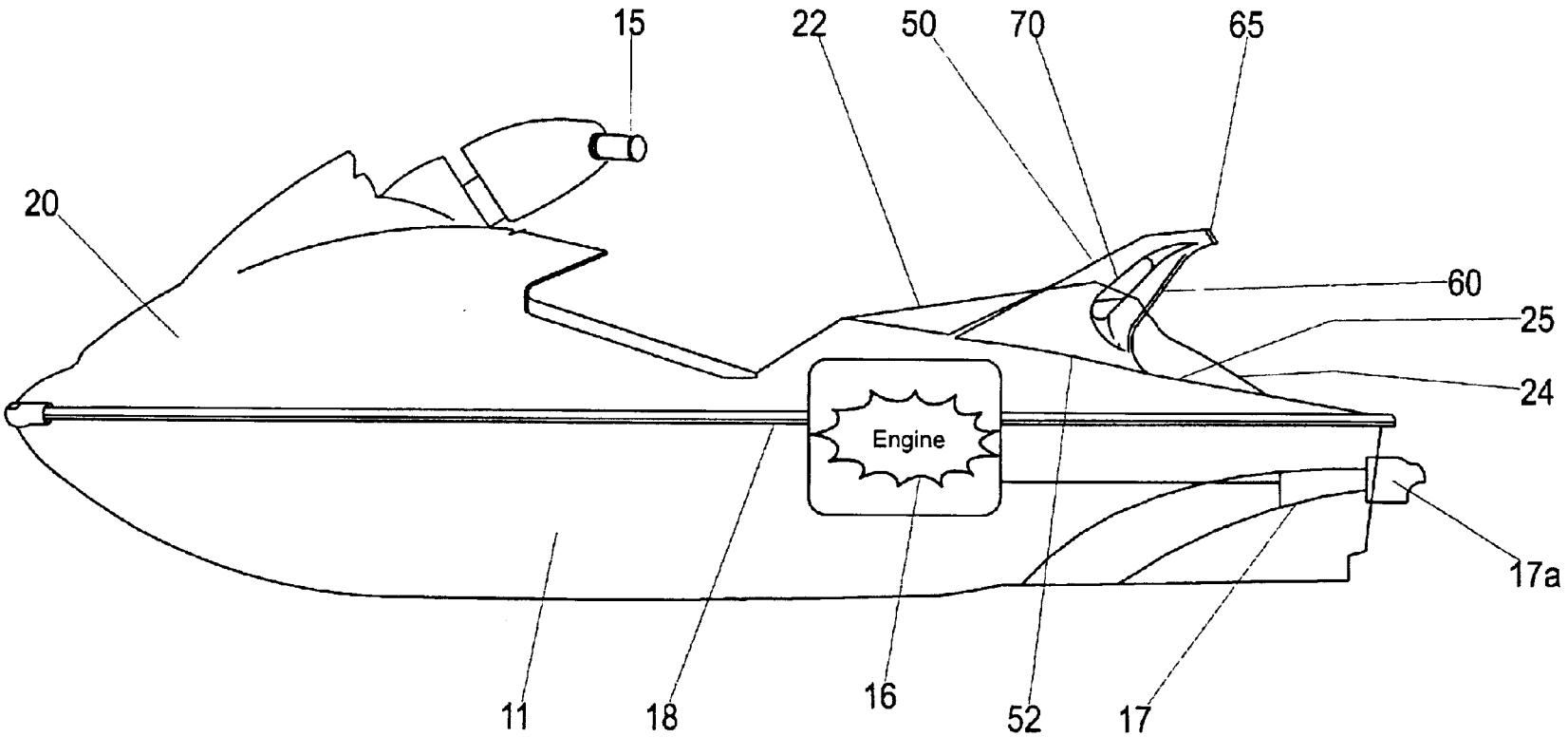
FIG. 2 is a side view of a personal watercraft of the present invention showing a rear handle, engine, and propulsion unit in dotted lines.

As is shown in phantom lines in FIG. 2, an engine 16 is disposed in the hull 11. The engine 16 is operatively arranged to drive power a propulsion unit 17, also shown in phantom lines. A steering unit 15 is provided to steer the propulsion unit 17. Typically, the steering unit 15 is connected to a pivotable nozzle (not shown) at the discharge end of the propulsion unit 17. As the steering unit 15 turns, so does the nozzle. This causes the watercraft 10 to turn.

Returning to FIG. 1, a deck 20 is supported by the hull 11 at a position above the hull 11. The deck is attached to the hull 11 at a junction 18. The junction 18 is substantially horizontally disposed.

Figure 3:
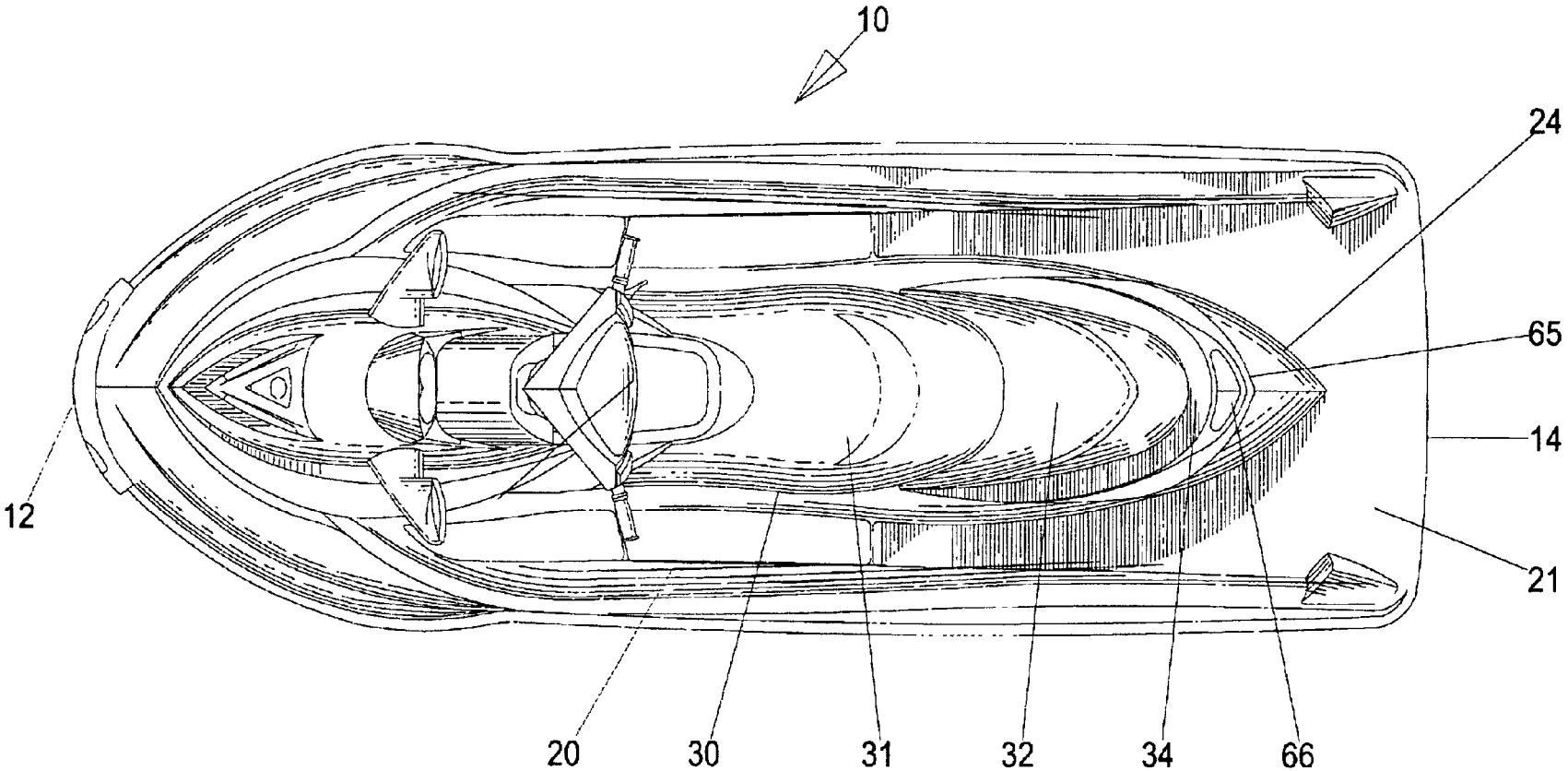
FIG. 3 is a top view of a personal watercraft of the present invention.

As shown in FIG. 3, the deck 20 includes a re-boarding platform 21, which is disposed at the rear portion of the deck 20 proximate to the stem 14. The re-boarding platform 21 is substantially horizontally disposed. The re-boarding platform 21 is defined by the deck at a position proximate to the stern. The re-boarding platform 21 serves as a platform onto which a user of the personal watercraft 10 can re-board the personal watercraft 10 from the water:

Returning to FIG. 2, the deck 20 has a pedestal 22, which extends upwardly at the rear portion of the deck 20. The pedestal 22 extends upwardly with respect to the re-boarding platform 21. An engine access opening (not shown) extends through the top of the pedestal 22 below a removable seat 30 (FIG. 1), through which the engine 16 can be accessed. In the illustration of FIG. 2, the seat 30 has been removed to show the profile of the watercraft 10 as it would appear when access to the engine 16 is required. FIG. 2 also illustrates that the entirety of the seat 30 may be removed, when warranted.

Returning to FIG. 1, the removable seat 30 is supported by the pedestal 22. The seat 30 covers the engine access opening. The seat 30 includes a first sitting position 31, a second sitting position 32, and a top surface 34 defining the uppermost position of the seat relative to the deck 20. The seat 30 is secured to the deck 20 using a latch mechanism (not shown) or other mechanism as would be apparent to one skilled it the art. Removal of the seat 30 provides access to the engine 16 through the access opening. As indicated above, FIG. 2 shows the personal watercraft 10 subsequent to the removal of the seat 30 from the pedestal 22.

As shown in FIG. 1, a rear handle 50 is rigidly attached to the pedestal 22 proximate to the pedestal rear portion 24. Specifically, the handle 50 includes a first attachment portion 52, through which the handle 50 is rigidly attached to an attachment surface 25 located on the pedestal 22 proximate to the pedestal rear portion 24. The handle 50 has an elongate hand hold 60, which is disposed at a vertical position below the seat top surface 34 and above the re-boarding platform 21 (as shown in FIGS. 1 and 3). The hand hold 60 comprises a bridge of material, which spans between a top attachment position 61 and a bottom attachment position 62. The hand hold 60 is disposed at an angle with respect to a horizontal surface, such as a plane defined by the junction 18 of the deck and the hull, or alternatively, the plane defined by the re-boarding platform 21. The bottom attachment position 62 is shown disposed forwardly of the top attachment position 61. Preferably, the hand hold 60 is disposed at an angle of at least 30 degrees with respect to a horizontal surface such as the junction 18 or the re-boarding platform 21. Optimally, the hand hold 60 is disposed at an angle of at least about 50 degrees. The hand hold 60, as is shown to scale in FIG. 1, is preferably tapered. In the specific embodiment shown in FIG. 1, the hand hold 60 has a rearward surface 63 disposed at an angle of about 55 degrees with respect to the horizontal and a forward surface 64 disposed at an angle of about 46 degrees.

Figure 5:
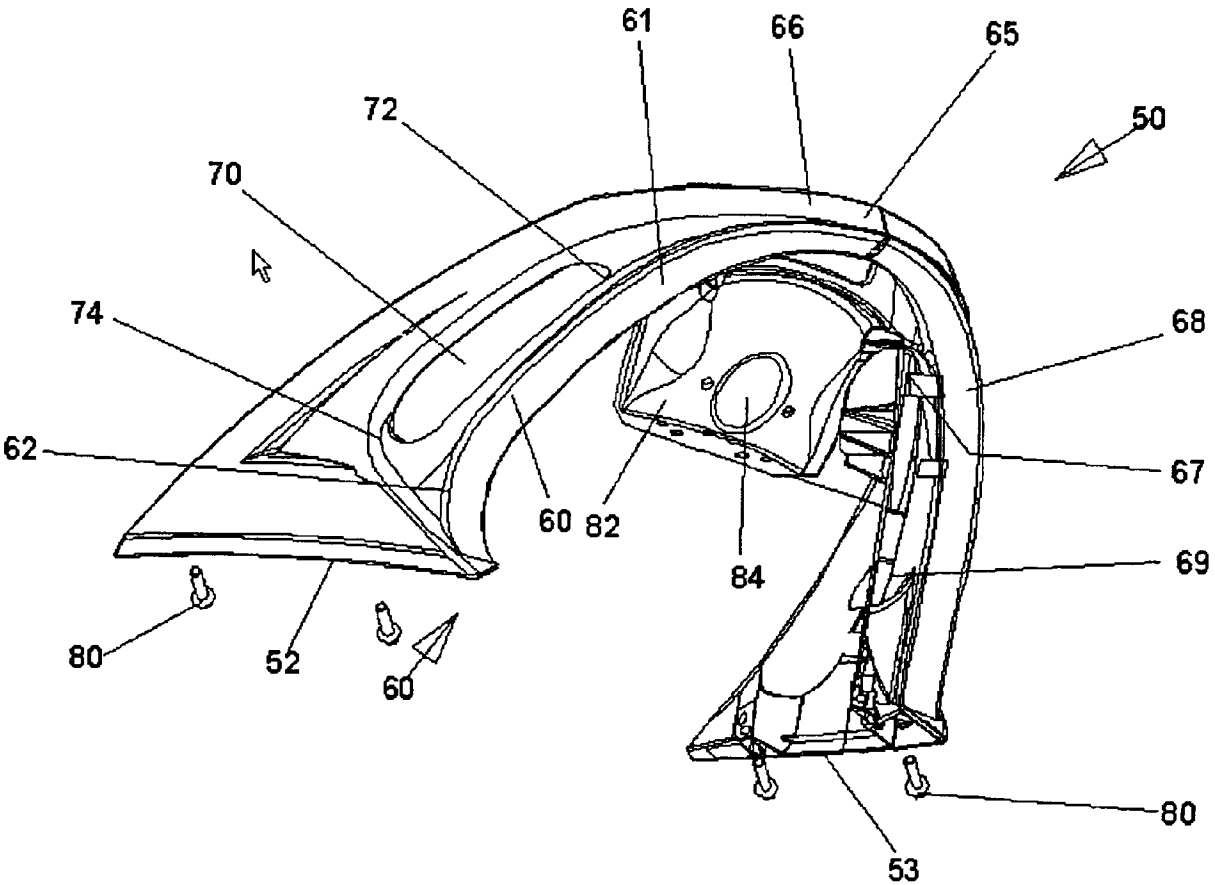
FIG. 5 is a perspective view, from the back, of a handle for the personal watercraft of the present invention.

The hand hold 60 is preferably integrally formed with the handle 50. The handle 50 is preferably separately formed from the pedestal 22 and is attached to the pedestal 22 through at least one fastener 80 (as shown in FIG. 5). The handle 50 is preferably molded from plastic, whereas the deck 20 is typically manufactured from a fiberglass reinforced material such as sheet molding compound (SMC). As would be apparent to one skilled in the art, it could be possible to manufacture the handle 50 and deck 20 integrally as a single unit. In any case, upon the attachment of the handle 50 to the pedestal 22, the handle 50 becomes integrated into the pedestal 22.

The hand hold 60 is separated from the main portion of the handle 50 by an elongate opening 70. The elongate opening 70 is disposed at an angle substantially equal to that of the hand hold 60. The hand hold 60 is disposed rearwardly with respect to the opening 70. The length of the opening 70 is essentially the same length as the hand hold 60, as the provision of the opening 70 into the handle 50 creates the bridge of material which is the hand hold 60. The hand hold 60 preferably has a thickness suitable for a human hand to surround and grasp easily.

Figure 4:
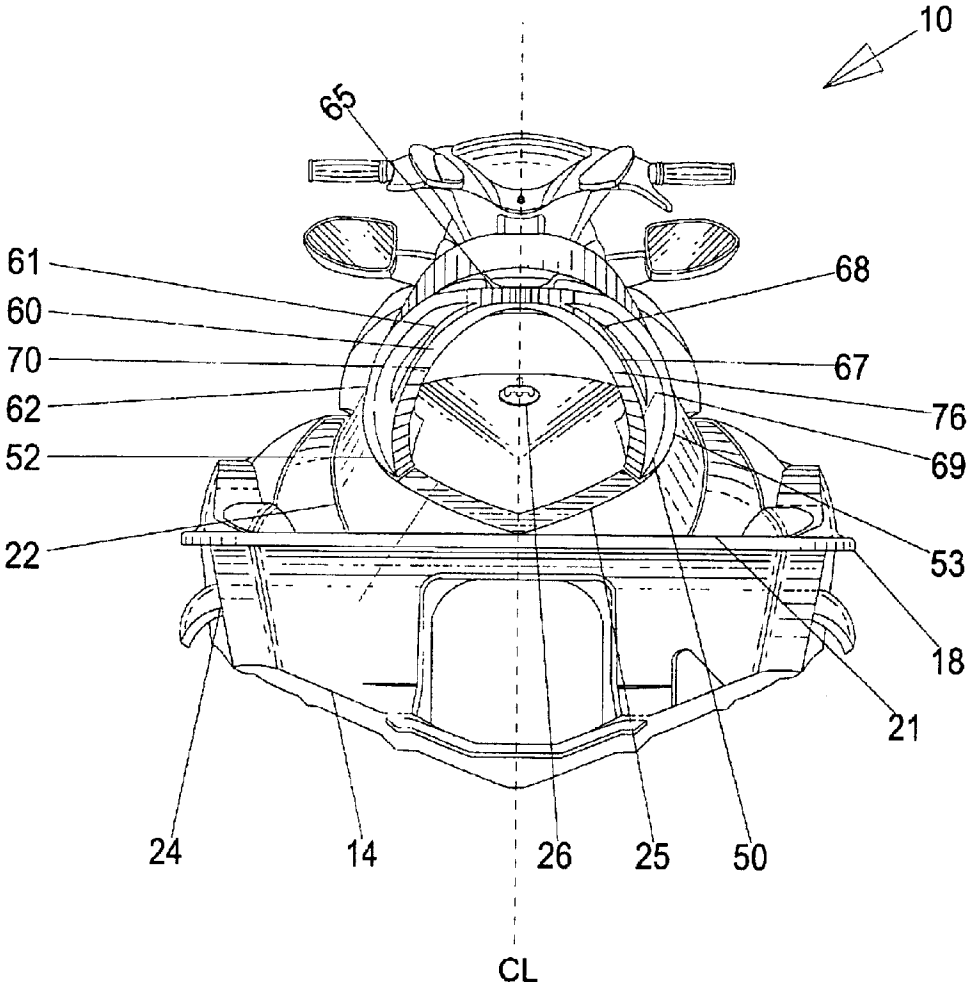
FIG. 4 is a rear view of a personal watercraft of the present invention.

As shown in FIG. 4, the hand hold 60 is disposed on a port side of the personal watercraft with respect to the centerline (C.L.) of the personal watercraft 10. The handle 50 further has a second hand hold 67. The second hand hold 67 is preferably a mirror image of the first hand hold 60. The second hand hold 67 is disposed on the starboard side of the personal watercraft 10 with respect to the centerline (C.L.) of the personal watercraft 10. The second hand hold 67 is disposed rearwardly of an elongate opening 76 in the same manner as the first hand hold 60. The second hand hold 67, like the first hand hold 60 is disposed at a vertical position below the seat top surface 34 and above the re-boarding platform 21. The top attachment positions 61, 68 are disposed at a distance closer to the centerline than the bottom attachment positions 62, 69 for both hand holds 60, 67. The first and second hand holds 60, 67 are also shown in their respective positions which are slightly inward (toward the centerline (C.L.) with respect to the elongate openings 70, 76.

As is also shown in FIG. 4, the handle 50 straddles a rear portion 24 of the pedestal 22, and is attached to the pedestal on opposite sides of the centerline (C.L.). Consequently, a large gap separates the first and second hand holds 60, 67 providing access to the tow hook 26 which is preferably disposed on the pedestal rear portion 24 along the centerline (C.L.) of the personal watercraft 10. The tow hook 26 is disposed forwardly relative to the first and second hand holds 60, 67. Accordingly, in the event that a tow rope (not shown) is secured to the tow hook 26, the first and second hand holds 60, 67 will not interfere with the tow rope.

FIG. 5 shows the handle 50 separate from the deck 20. As was previously shown in FIG. 4, the second hand hold 67 spans between top 68 and bottom 69 attachment positions on the handle 50. Like the first hand hold 60, the second hand hold 67 is preferably disposed at an angle of at least about 30 degrees with respect to a horizontal surface such as the junction 18 or the re-boarding platform 21. Optimally, the second hand hold 67 is disposed at an angle of at least about 50 degrees. In the specific embodiment of the invention shown in FIGS. 1–5, the second hand hold 67, like the first hand hold 60, has a rearward surface disposed at an angle of 55 degrees with respect to the horizontal and a forward surface disposed at an angle of about 46 degrees.

As is best shown in FIG. 5, the handle 50 has an arch shape having a first base section 52 and a second base section 53. The first and second base sections 52, 53 form the attachment of the handle 50 to the pedestal 20. Threaded fasteners 80 are shown which are one of many types of fasteners that may be used to secure the handle 50 to the deck 20, as would be apparent to one skilled in the art. Alternatively, the handle 50 could be affixed to the deck 20 by a suitable adhesive.

As is shown in FIGS. 3 and 5, the handle further has a third hand hold 65 disposed at a top portion of the arch intermediate the first hand hold 60 and second hand hold 67. As can be best appreciated from FIGS. 1 and 4, the third hand hold 65 is preferably disposed in a generally horizontal orientation. The third hand hold 65 is disposed rearwardly of an elongate opening 66.

Returning again to FIG. 5, the handle 50 further includes a seat receiving portion 82 having an opening 84 within which a seat attachment pin (not shown) may be disposed such that a seat latch (not shown) may be attached to the seat attachment pin.

Although the handle 50 is shown as a single unit having three hand holds 60, 65, and 67, it would be apparent to one skilled in the art that the hand holds 60, 65, and 67 could each have been manufactured separately and individually attached to the deck 20. Alternatively, although the handle 50 is shown as an element manufactured separately from the deck, the handle 50 is rigidly attached to the deck and thus becomes part of the deck. Therefore, it would be apparent to one skilled in the art that the hand holds 60, 65, and 67 could be integrated into the deck during the manufacture of the deck.

In use, the handle 50 provides a seated user multiple positions in which he may place his hands. A seated passenger facing forward may place his hands behind him on the third hand hold 65. Similarly a seated passenger facing rearward may place his hands behind him on the third hand hold 65. Someone re-boarding the personal watercraft 10 from the water could grasp the first and second hand holds 60, 67 simultaneously and pull himself onto the re-boarding platform with both hands. The first and second hand holds 60, 67 are ergonomically positioned to provide the user the maximum ease in holding onto the hand holds while re-boarding the personal watercraft 10. A ladder (not shown) may also be provided at the stern 14 of the watercraft 10 below the level of water to further assist a person in re-boarding the personal watercraft.

While the invention has been described with reference to a preferred embodiment, it will be understood by those skilled in the art that various changes may be made and equivalents may be substituted for elements thereof without departing from the spirit and scope of the present invention. In addition, many modifications may be made to adapt a particular situation, component, or material to the teachings of the present invention without departing from its teachings as claimed.

What is claimed is:

1. A personal watercraft comprising:

a hull having a bow and a stem;

an engine disposed in the hull;

a propulsion unit operatively connected to and driven by the engine;

a steering unit operatively connected to the propulsion unit to steer the propulsion unit;

a deck supported above the hull, the deck comprising a substantially horizontal re-boarding platform proximate to the stern and a pedestal extending upwardly with respect to the re-boarding platform;

a seat having a top surface supported on the pedestal;

a handle attached to a rear portion of one of the pedestal or the deck, the handle including an elongate hand hold being disposed below the seat top surface and above the re-boarding platform, the hand hold spanning between top and bottom attachment positions, the top attachment position being disposed rearwardly of the bottom attachment position, the hand hold being defined by an elongate opening, the hand hold being disposed rearwardly of the opening.

2. The personal watercraft of claim 1, wherein the hand hold is disposed at an angle of at least about 30 degrees With respect to the re-boarding platform.

3. The personal watercraft of claim 1, wherein the hand hold is disposed at an angle of at least about 50 degrees with respect to a horizontal surface.

4. The personal watercraft of claim 1, wherein:

the hand hold is integrally formed with the handle; and the hand hold comprises a bridge of material spanning between the top and bottom attachment positions disposed on the handle.

5. The personal watercraft of claim 1, wherein the handle comprises a first hand hold, the first hand hold being disposed on a port side of the personal watercraft with respect to the centerline or the personal watercraft, the handle further comprising a second hand hold, the second hand hold being disposed on a starboard side of the personal watercraft with respect to the centerline of the personal watercraft.

6. The personal watercraft of claim 5, wherein the second hand hold is disposed below the seat top surface and above the re-boarding platform, the second hand hold spanning between top and bottom attachment positions on the handle, the second hand hold disposed at an angle of at least about 30 degrees with respect to a horizontal surface.

7. The personal watercraft of claim 6, wherein the second hand hold is defined by a second elongate opening and is disposed rearwardly of the second elongate opening.

8. The personal watercraft of claim 5, wherein the second hand hold is disposed at about the same angle with respect to the horizontal as the first hand hold.

9. The personal watercraft of claim 5, wherein the first and second hand hold top attachment positions are disposed closer to the centerline than the bottom attachment positions.

10. The personal watercraft of claim 5, wherein the handle further includes a third hand hold disposed between the first and second hand holds.

11. The personal watercraft of claim 10, wherein the third hand hold is disposed in a generally horizontal orientation.

12. The personal watercraft of claim 1, wherein the handle has an arch shape extending between a first base section and a second base section, the first and second base sections attaching the handle to one of the pedestal or the deck.

13. A grab handle for a watercraft, comprising:

a body attachable to a watercraft, the body having a central, generally horizontal portion and right and left side portions extending downwardly from the central portion to right and left bottom edges, wherein the body defines a hand hold within the central portion and right and left elongate hand holds extending along the right and left side portions from positions adjacent the central portion to positions adjacent bottom edges of the right and left side portions, the right and left side portions including right and left elongate openings, the right and left elongate hand holds being disposed rearwardly of the right and left elongate openings.

14. The grab handle of claim 13, wherein the right and left hand holds are both disposed at angles of at least about 30 degrees with respect to the horizontal portion.

15. The grab handle of claim 14, wherein the right and left hand holds are disposed at angles of at least about 50 degrees with respect to the horizontal portion.

* * * * *